US006220142B1

(12) United States Patent
Rothhaar

(10) Patent No.: US 6,220,142 B1
(45) Date of Patent: Apr. 24, 2001

(54) MANUALLY OPERATED EMERGENCY CONTROL ACTUATION DEVICE

(75) Inventor: Stefan Rothhaar, St. Wendel (DE)

(73) Assignee: Flutec Fluidtechnische Gerate Gmbh, Sulzbach (DE)

( * ) Notice: Subject to any disclaimer, the term of this patent is extended or adjusted under 35 U.S.C. 154(b) by 0 days.

(21) Appl. No.: 09/297,049

(22) PCT Filed: Mar. 19, 1998

(86) PCT No.: PCT/EP98/01616

§ 371 Date: Apr. 28, 1999

§ 102(e) Date: Apr. 28, 1999

(87) PCT Pub. No.: WO98/53213

PCT Pub. Date: Nov. 26, 1998

(30) Foreign Application Priority Data

May 22, 1997 (DE) ..... 197 21 404

(51) Int. Cl.[7] ..... F15B 11/08
(52) U.S. Cl. ..... 91/422; 60/402
(58) Field of Search ..... 60/400, 401, 402; 91/422; 417/205, 374, 545, 546, 547

(56) References Cited

U.S. PATENT DOCUMENTS

| | | | | |
|---|---|---|---|---|
| 1,323,168 | * | 11/1919 | De Rigne | 417/547 |
| 1,347,434 | * | 7/1920 | Avery | 417/547 X |
| 1,416,445 | * | 5/1922 | Burd et al. | 417/547 |
| 3,298,315 | * | 1/1967 | Irgens | 417/205 |
| 3,787,149 | * | 1/1974 | Dane et al. | 417/554 |
| 4,738,107 | * | 4/1988 | Carlander | 417/374 X |
| 5,201,639 | | 4/1993 | Reineck | 417/546 X |
| 5,494,410 | * | 2/1996 | Maier-Laxhuber et al. | 417/545 X |

FOREIGN PATENT DOCUMENTS

| | | |
|---|---|---|
| 745289 | 12/1943 | (DE) . |
| 3344132 | 6/1984 | (DE) . |
| 1392507 | 6/1965 | (FR) . |
| 911340 | 11/1962 | (GB) . |

* cited by examiner

*Primary Examiner*—John E. Ryznic
(74) *Attorney, Agent, or Firm*—Roylance, Abrams, Berdo & Goodman, L.L.P.

(57) ABSTRACT

An actuation device for emergency operation of a hydraulically controlled actuator includes a housing with a fluid container connected to the actuator via a connection point and to a hydraulic supply circuit of the actuator via another connection point. A separating piston is guided lengthwise inside the fluid container via a manually operated adjusting device. The piston has a control device for a through-opening joining the connection points to each other. The actuation device provides an economical and simple way of reliably controlling and monitoring the hydraulically controlled actuator in case of malfunction by an adjustment screw screwed or unscrewed on the housing. The screwing path is chosen such that the cooperating separating piston can be displaced between two end positions. The through-opening of the separating piston has a check valve which is opened at one end position and is closed at the other.

24 Claims, 3 Drawing Sheets

MANUALLY OPERATED EMERGENCY CONTROL ACTUATION DEVICE

FIELD OF THE INVENTION

The present invention relates to an operation actuation device for a hydraulically controlled actuator, especially for its emergency operation. A housing incorporates a fluid container which can be connected through one connection point to the actuator and through another connection point to a hydraulic supply circuit of the actuator. A separating piston is guided longitudinally slidably within the fluid container by a manually operable adjusting device. The piston includes a control device controlling a through-flow opening connecting the connection points with one another.

BACKGROUND OF THE INVENTION

When a breakdown or disruption of the hydraulically controlled actuator, generally in the form of a hydraulically operable working cylinder, occurs, for example as a result of current interruption, the actuator can usually no longer be operated. Those occurrences can lead to dangerous disturbances, especially in areas relevant to technical security and/or safety, such as in nuclear power plants or the like. Conventionally, in such operation emergency situations, separate and independent emergency operation systems are activated. However, these emergency operation systems are costly to manufacture and set up, and generally are located so far removed from the site of disturbance that the emergency operation cannot be directly monitored by the operator.

DE 33 44 132 C2 discloses an operation device for a hydraulically controlled actuator which has a housing incorporating a fluid container connected through one connection point to the actuator and through another connection point to a supply circuit. Within the fluid container, a separating piston is guided longitudinally slidably by a manually operable adjusting device in the form of a pump handle. The pump handle cooperates with a mechanically working control device working separately in the form of a sliding piston to generate a through-flow opening connecting the fluid connection points with one another.

When this known arrangement is provided for emergency actuation of the hydraulically controlled actuator, no conclusions can be derived from the setting of the pump handle regarding whether an operationally secure and/or safe emergency operation has taken place or not. The known control device in the form of the longitudinally movable sliding piston is controlled exclusively by the fluid pressure, leading to erroneous control of the known control device and independent of the setting of the separating piston controlled by the pump handle. Additionally, because of the plurality of parts in the known solution, it is costly to manufacture.

SUMMARY OF THE INVENTION

Objects of the present invention are to provide an operation actuation device providing, in disruptive situations, a simple and low-cost system for controlling the hydraulically controlled actuator that is operationally secure and safe and that can be monitored from the outside.

The foregoing objects are basically obtained by an operation actuation device for emergency actuation of a hydraulically controlled actuator, comprising a housing having a fluid container with an actuator connection point and a hydraulic circuit connection point. A separating piston is guided for longitudinal sliding movement in the housing between first and second end settings. A manually operable adjusting setscrew is coupled to and controls movements of the piston in the housing. The setscrew is threadedly engaged with the housing and is axially movable relative to the housing to move the piston between the end positions. A through-flow opening in the piston is controlled by a control check valve therein and provides controlled fluid communication between the connection points. The check valve is opened in the first end setting by engagement with a part of the housing and is closed in the second end setting by being spaced from the part of the housing.

Since the adjusting device is a setscrew which can be screwed into and out of the housing, the setscrew screwing-in length is determined so that the separating piston cooperating with it can be moved between two end settings. The check valve, operated in the end settings by the separating piston, is mechanically controlled in a pro-active manner, and thus, is operationally secure. The separating piston, through a single, non-repetitive delivery movement of the setscrew, specifically assumes the relevant end setting. Consequently, a mechanically specific coupling between setscrew, separating piston and check valve is generated. Such coupling is exceptionally operationally secure and safe, and consequently, is especially suitable for emergency operation of the actuator.

The position of the setscrew, screwed fully in or out, allows the on-site operator an immediate overview of whether or not an effective emergency operation system for the actuator exists.

The operation actuation device according to the present invention includes only a few structural parts and consequently can be realized simply and at low cost. Using the manually operable adjusting device, the setting process and consequently the operation of the controlled actuator can be monitored precisely on site by the operator. Erroneous control actions are avoided. With sufficient oil volume stored in the fluid container, external readiness setting of control fluid is not necessary. Fluid control by means of the operation actuation device occurs without leakage, so that an operationally secure and/or safe manual emergency operation is guaranteed.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
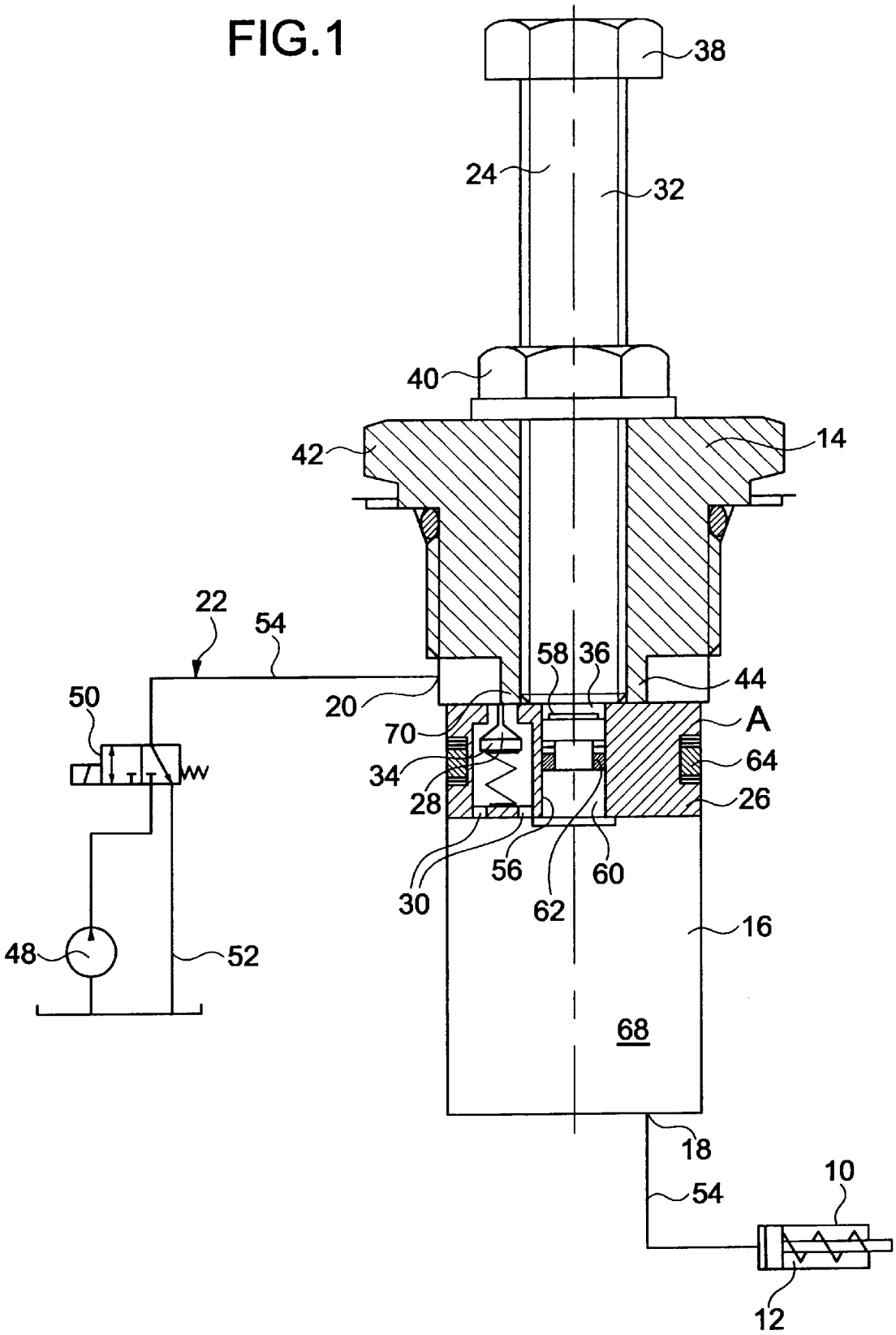
FIG. 1 is a partial, front elevational view, partially in section, of an actuation device, integrated as a part of a supply circuit in standard operation, according to a first embodiment of the present invention.
Figure 2:
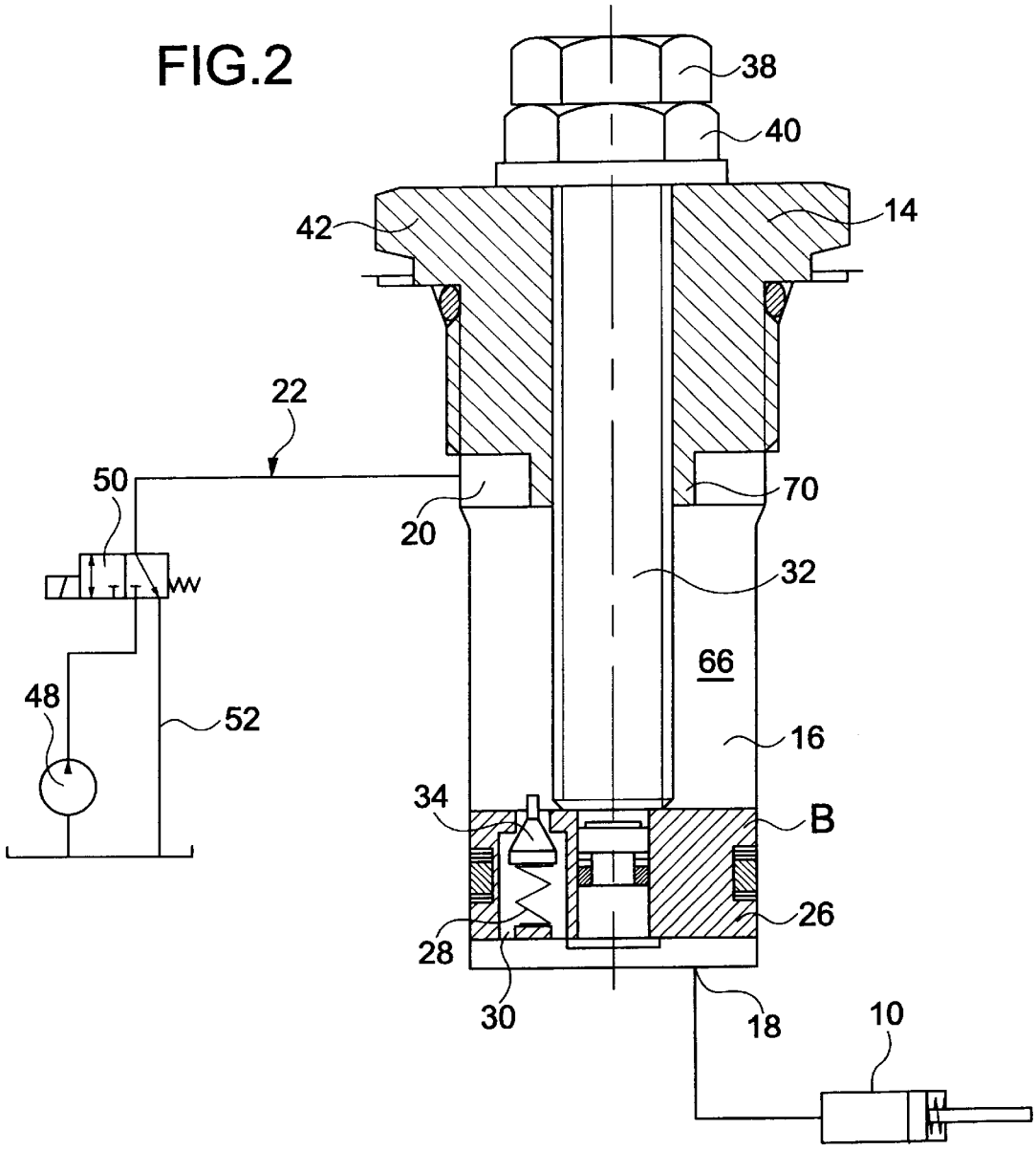
FIG. 2 is a partial, front elevational view, partially in section, of the actuation device of FIG. 1 in emergency manual operation.

The operation actuation device, shown in FIGS. 1 and 2, permits emergency actuation of a hydraulically controlled actuator 10 in the form of a spring-biased hydraulic working cylinder 12. The operation actuation device is provided with a housing 14, incorporating a fluid container 16 connected through one connection point 18 to actuator 10 and through another connection point 20 to a hydraulic supply circuit, indicated in its entirety with 22, for actuator 10. Within fluid container 16 a separating piston 26 is guided for longitudinal sliding movement by means of a manually operable adjusting device 24. The piston incorporates a control device 28 controlling a through-flow opening 30 connecting connection points 18 and 20 with one another.

The manually operable adjusting device 24 comprises a setscrew 32 which can be screwed into and out of housing 14. The possible screwing-in length is determined in such a manner that separating piston 26, cooperating with the adjusting device, is longitudinally slidable between two end settings A and B. Through-flow opening 30 of separating piston 26 has a spring-biased control check valve 34 forming control device 28, which is opened in one of the end settings A or B and is closed in the other end setting B or A.

Setscrew 32 engages with its free end 36 in separating piston 26. Between this free end 36 and the screwhead 38, a locknut 40, with setscrew 32 passing through it, is supported on housing 14. Housing 14 is configured as a sort of one-screw die 42, can be screwed by means of corresponding exterior threading into an interior threading according to a universally recognized mounting arrangement for control blocks or the like, and can also be removed therefrom. As explained in greater detail hereinafter, parts 44 and 46 of housing 14 in one end setting A or B control the control device 28 when through-flow opening 30 is opened.

As is shown particularly in FIGS. 1 and 2, supply circuit 22 has a hydraulic pump 48, a pilot valve 50 in the form of an electrically operable 3/2-way valve which can be set back with a spring, as well as a reservoir connection 52. Both connection points 18 and 20 are connected in a supply line 54 between supply circuit 22 and actuator 10. Furthermore, separating piston 26 has a centering opening 56, which serves for the contact-engagement of setscrew 32 and is accessible by means of a frontal journal 58. Centering opening 56 is closed and sealed by means of a stopper plug 60 with surrounding annual seal joint 62.

Separating piston 26 is guided longitudinally slidably within fluid container 16 where it seals off two container areas 66 and 68 from one another by means of another annular seal 64. Check valve 34 is guided under control in the embodiment of FIGS. 1 and 2 counter to the spring force over an annular flange 70 projecting in a downward direction, as seen in FIG. 1, and consequently frees the through-flow path to through-flow opening 30. The blocking path for the blocking check valve 34 then runs parallel to the longitudinal alignment of the possible blocking movement for setscrew 32.

For clarification of the actuating device according to the present invention, its operation is described with reference to FIGS. 1 and 2.

When not in operation, as shown in FIG. 1, setscrew 32 is screwed out into its topmost position. Thus, separating piston 26 is positioned at its top abutment formed by annular flange 70. As already described, the built-in check valve 34 is therefore thrust mechanically counter to its spring force. Consequently, free passage of fluid in either direction is guaranteed through through-flow opening 30; and the user in the form of working cylinder 12 can be supplied with pressurized oil by the hydraulic pressure pump 48, dependent upon the setting of pilot valve 50.

If hydraulic pump 48 is out of order, for example, because of a current interruption, working cylinder 12 is moved automatically into its start setting shown in FIG. 1 by means of its own return spring. Consequently, with a current interruption, multi-way valve 50 is moved into its switch setting shown in FIGS. 1 and 2, in other words hydraulic pump 48 would be blocked from supply line 54. If at this point setscrew 32 is screwed into housing 14, check valve 34 is closed to block off the discharge flow through supply line 54 to reservoir connection 52 and consequently to prevent loss of pressurized oil. With this adjusting movement placing separating piston 26 in its bottom end setting B, the fluid stored in container 16 is forced out of container area 68 and pressed into working cylinder 12, counter to the return force of its spring, so that the arrangement finally assumes its actuated setting shown in FIG. 2. The setting of setscrew 32, as shown in FIG. 2, thus shows clearly and without question that emergency actuation has taken place. The control of the operation is consequently very simple and obvious to recognize. Setscrew 32 is provided in this case with exterior threading over its entire exterior circumference that engages in the associated interior threading of housing 14.

Figure 3:
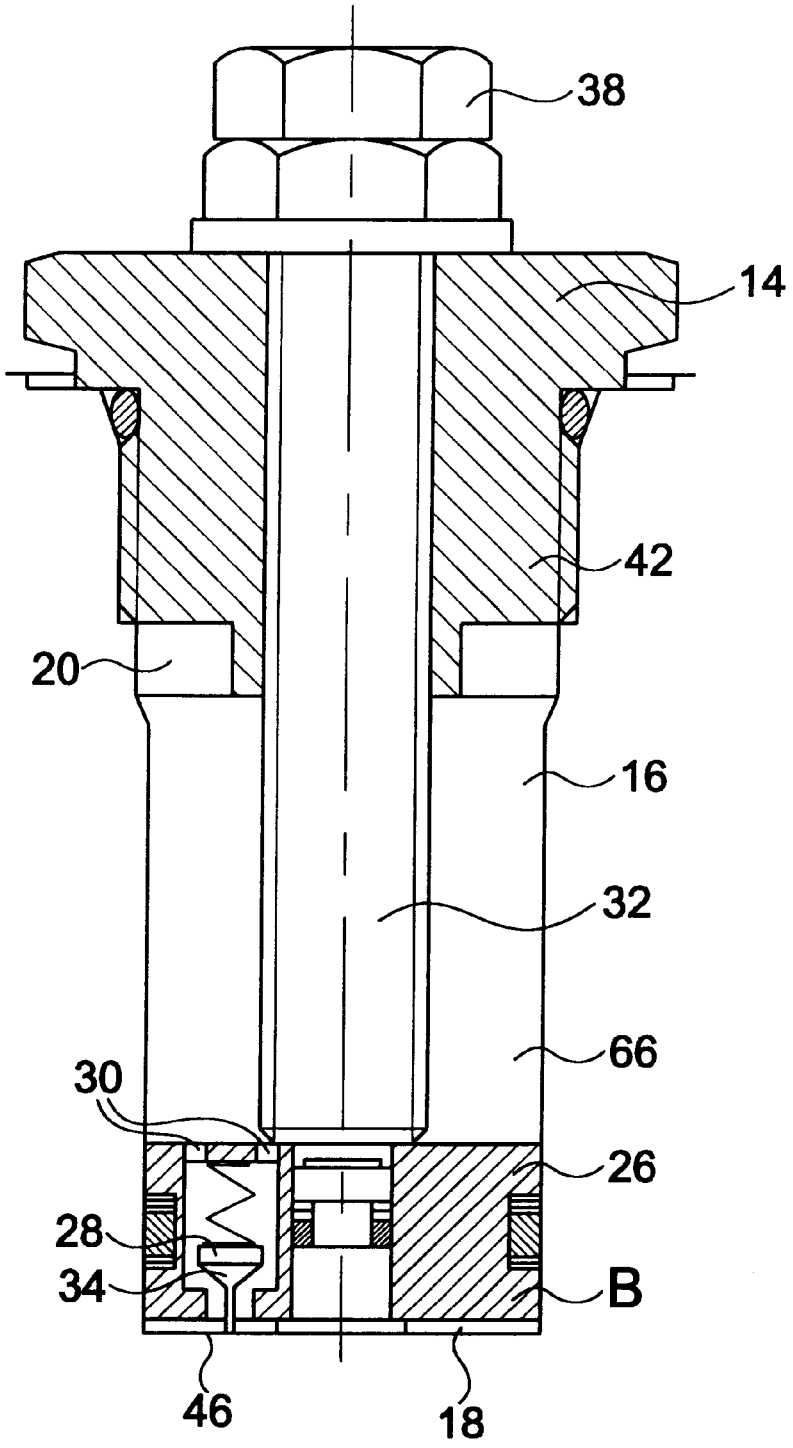
FIG. 3 is a partial, front elevational view, partially in section, of an actuation device according to a second embodiment of the present invention.

A modified second embodiment of the actuation device of the present invention is illustrated in FIG. 3. This arrangement is described only insofar as the modified embodiment differs considerably from the first embodiment described heretofore. The same number references are used for the same structural parts.

In the second embodiment of FIG. 3, standard operation is guaranteed in that separating piston 26 as shown, is arranged in bottom end setting B. With this configuration, the control device for check valve 34 works in reverse, in other words it is controlled by means of its control pin or the like engaging a limited surface of bottom part 46 of housing 14. With the second embodiment, the standard operation is provided when setscrew 32 is completely screwed in. As opposed to the former description, the emergency operation actuation function would be provided in the second embodiment when setscrew 32 would be screwed out of housing 14 beyond screwhead 38. Separating piston 26 would be carried upward with it and through-flow opening 30 would be controlled by closing of check valve 34. The fluid conducted by the force of the spring of actuator 10 into container 68 then allows for emergency actuation of the cylinder in the other direction. Setscrew 32 can also be connected in one piece integral with journal 58, as well as with stopper plug 60. The pro-active control of the separating piston in both directions is possibly be means of the design of setscrew 32 with screwhead 38.

Since the present operation actuation device can be constructed modularly, according to the needs of the user, different oil volumes can also be made available. An adaptation thus occurs of the available volume of fluid storage container 16. The described construction is simple and can be manufactured at low cost. The operation actuation device according to the invention has proven especially advantageous when used with cart conveyor vehicles, especially with fork lifts, where it can be actuated in case of breakdown of the motor so that the operator is able to release the parking brakes.

While various embodiments have been chosen to illustrate the invention, it will be understood by those skilled in the art that various changes and modifications can be made therein without departing from the scope of the invention as defined in the appended claims.

What is claimed is:

1. An operation actuation device for emergency actuation of a hydraulically controlled actuator, comprising:

a housing having a fluid container with an actuator connection point and a hydraulic circuit connection point;

a separating piston guided for longitudinal sliding movement in said housing between first and second end settings;

a manually operable adjusting setscrew coupled to and controlling movement of said piston in said housing, said setscrew being threadedly engaged with said housing and axially movable relative to said housing to move said piston between said end positions; and a through-flow opening in said piston controlled by a control check valve therein and providing controlled fluid communication between said connection points, said check valve being opened in said first end setting by engagement with a part of said housing and being closed in said second end setting by being spaced from said part of said housing.

2. An operation actuation device according to claim 1 wherein said setscrew comprises a free end engaging said piston and a screwhead at an opposite end thereof; and a locknut is supported on said housing between said free end and said screwhead, said setscrew extending through said locknut.

3. An operation actuation device according to claim 2 wherein said housing comprises a single screw die.

4. An operation actuation device according to claim 1 wherein said housing comprises a single screw die.

5. An operation actuation device according to claim 4 wherein said actuator connection point is connected to a spring biased, hydraulically operating cylinder.

6. An operation actuation device according to claim 2 wherein said actuator connection point is connected to a spring biased, hydraulically operating cylinder.

7. An operation actuation device according to claim 1 wherein said actuator connection point is connected to a spring biased, hydraulically operating cylinder.

8. An operation actuation device according to claim 7 wherein said hydraulic circuit connection point is connected to a supply circuit, said supply circuit including at least one hydraulic pump, at least one pilot valve and at least one reservoir connection.

9. An operation actuation device according to claim 5 wherein said hydraulic circuit connection point is connected to a supply circuit, said supply circuit including at least one hydraulic pump, at least one pilot valve and at least one reservoir connection.

10. An operation actuation device according to claim 2 wherein said hydraulic circuit connection point is connected to a supply circuit, said supply circuit including at least one hydraulic pump, at least one pilot valve and at least one reservoir connection.

11. An operation actuation device according to claim 1 wherein said hydraulic circuit connection point is connected to a supply circuit, said supply circuit including at least one hydraulic pump, at least one pilot valve and at least one reservoir connection.

12. An operation actuation device according to claim 11 wherein said connection points are connected in a supply line between said supply circuit and a hydraulically controlled actuator.

13. An operation actuation device according to claim 8 wherein said connection points are connected in a supply line between said supply circuit and said hydraulically operating cylinder.

14. An operation actuation device according to claim 5 wherein said connection points are connected in a supply line between a supply circuit and said hydraulically operating cylinder.

15. An operation actuation device according to claim 2 wherein said connection points are connected in a supply line between a supply circuit and a hydraulically controlled actuator.

16. An operation actuation device according to claim 1 wherein said connection points are connected in a supply line between a supply circuit and a hydraulically controlled actuator.

17. An operation actuation device according to claim 16 wherein said piston comprises a centering opening engaging said setscrew and sealed closed by a stopper plug.

18. An operation actuation device according to claim 12 wherein said piston comprises a centering opening engaging said setscrew and sealed closed by a stopper plug.

19. An operation actuation device according to claim 8 wherein said piston comprises a centering opening engaging said setscrew and sealed closed by a stopper plug.

20. An operation actuation device according to claim 5 wherein said piston comprises a centering opening engaging said setscrew and sealed closed by a stopper plug.

21. An operation actuation device according to claim 2 wherein said piston comprises a centering opening engaging said setscrew and sealed closed by a stopper plug.

22. An operation actuation device according to claim 1 wherein said piston comprises a centering opening engaging said setscrew and sealed closed by a stopper plug.

23. An operation actuation device according to claim 1 wherein said check valve comprises an axially extending projection protruding from said piston, said projection releasably engaging said part of said housing.

24. An operation actuation device according to claim 23 wherein said check valve comprises a body part with said projection and a biasing spring on opposite axial ends thereof.

* * * * *